US006204820B1

(12) United States Patent
Jensen, Jr.

(10) Patent No.: US 6,204,820 B1
(45) Date of Patent: Mar. 20, 2001

(54) ANTENNA MOUNT FOR AIR DRAG REDUCTION EQUIPMENT FOR MOTOR VEHICLES

(76) Inventor: William L. Jensen, Jr., 36 Macintosh Dr., Oxford, CT (US) 06478

( * ) Notice: Subject to any disclaimer, the term of this patent is extended or adjusted under 35 U.S.C. 154(b) by 0 days.

(21) Appl. No.: 09/422,709

(22) Filed: Oct. 21, 1999

(51) Int. Cl.[7] ..... H01Q 1/32

(52) U.S. Cl. ..... 343/713; 296/180.1

(58) Field of Search ..... 343/713; 296/180.1; 248/539

(56) References Cited

U.S. PATENT DOCUMENTS 5,961,092 * 10/1999 Coffield ..... 248/539

* cited by examiner

*Primary Examiner*—Don Wong
*Assistant Examiner*—James Clinger
(74) *Attorney, Agent, or Firm*—Mark P. Stone

(57) ABSTRACT

A device for mounting an antenna to a motor vehicle is arranged externally on air drag reduction equipment of the motor vehicle. The mounting device can be affixed to an external surface of the fairing, can be mounted in an opening cut from the fairing, or can be integrally defined on the outer surface of the fairing. The mounting device is arranged relative to the fairing so that it is at an optimum position and elevation relative to the top of the fairing and the roof of a trailer following behind the fairing so as to optimize signal transmission and reception, but avoid damage to the antenna during operation of the motor vehicle.

21 Claims, 8 Drawing Sheets

ANTENNA MOUNT FOR AIR DRAG REDUCTION EQUIPMENT FOR MOTOR VEHICLES

BACKGROUND OF THE INVENTION

The present invention is directed to antenna mounts for motor vehicles, and in particular antenna mounts for motor vehicles such as tractor trailers carrying air deflection or drag reduction equipment including roof fairings mounted to the cab of a vehicle, fairing shaped roofs, or fairing shaped raised roofs, to reduce air resistance during operation of the vehicle.

Roof fairings for motor vehicles, and in particular, tractor trailers, are generally known to the art, and are exemplified by U.S. Pat. Nos. 4,784,424; 4,919,472; 5,174,626; and 5,755,485. Roof fairings and other wind deflection apparatus are mounted to the roof of a cab of a tractor trailer truck for deflecting air over the front wall of a trailer being towed by the cab to reduce air resistance during operation of the tractor trailer. U.S. Pat. Nos. Des. 249,783; 314,163; and 339,314 disclose additional designs for wind deflection apparatus mounted to, or defined on, the roof of a cab for a tractor trailer truck.

U.S. Pat. Nos. 5,337,062; 5,389,942; 5,402,134; and 5,410,325, generally disclose antennas used in conection with motor vehicles.

U.S. Pat. Nos. 4,931,809 and 4,370,658 disclose antennas carried on air deflection apparatus mounted to the roof of a cab of a tractor trailer truck.

Known antenna mounts carried by air deflection apparatus of motor vehicles, and in particular roof fairings mounted to the cabs of tractor trailer trucks, exhibit several disadvantages. In order to protect the antenna from the external environment and to provide an aesthetically pleasing appearance, antennas have been mounted internally within the hollow volume of a roof fairing. However, by enclosing an antenna within the fairing, the fairing interferes with transmission and reception of radio signals. Additionally, mounting an antenna within a fairing restricts the manner in which the roof fairing is finished. For example, electro-static painting requires a conductive part such as aluminum or steel. Plastic and fiberglass parts require a conductive primer or gelcoat to compensate. However, conductive coatings adversely affect the transmission and reception of signals by an antenna enclosed under the fairing so that fairings which are intended to house an enclosed antenna cannot be efficiently painted by an electro-static process, but must be separately painted "off-line" by the truck manufacturer.

Known antennas mounted externally to roof fairings exhibit other disadvantages. These antennas extend above the top of the fairing and are subject to damage from overhead obstructions such as tree branches. Antennas which extend beyond the top of the fairing are subject to excessive stress and susceptible to damage during normal operation of the vehicle. Moreover, because a portion of the antenna extends above the top of the roof fairing, it adversely affects reduction of air resistance provided by the roof fairing during operation of the vehicle.

It is the primary object of the present invention to provide a device for mounting an antenna externally to air drag reduction apparatus for a motor vehicle, and in particular roof fairings mounted to the cab of a tractor trailer or roof fairings integrally formed as the roof or raised roof of the cab of a tractor trailer, overcoming the disadvantages of the known devices. In accordance with this primary objective, an antenna mount is affixed to the outer surface of a roof fairing, is mounted in an opening cut out from a roof fairing, or is integrally defined on the outer surface of a roof fairing, and is arranged and oriented relative to the roof fairing to optimize the efficiency of radio signal transmission and reception while reducing the disadvantages of known external antenna mounts. Therefore, the antenna mount in accordance with the present invention avoids the numerous disadvantages associated with internal antenna mounts enclosed within the hollow interior of a roof fairing, and optimizes the efficiency of an antenna mounted externally to a roof fairing or other drag reduction equipment carried by a motor vehicle. Other objects and advantages of the present invention will become apparent from the following description in conjunction with the drawings.

SUMMARY OF THE INVENTION

The present provides an improved antenna mount for motor vehicles, and in particular, tractor trailer trucks. The antenna mount is installed on air deflection equipment carried by the motor vehicle, and in particular, a fairing located above the cab portion of the motor vehicle. The antenna mount is installed on an external portion of the roof fairing by affixing it directly to a portion of the outer surface of the fairing, by installing it in an opening cut from the outer surface of the fairing, or by defining the roof mount integrally with a portion of the outer surface of the fairing during fabrication of the fairing. Preferably, the antenna mount is of a streamlined design to reduce aerodynamic drag which might be caused by the portion of the antenna mount extending beyond the outer surface of the roof fairing.

The antenna mount is oriented relative to the fairing such that the top of an antenna received in the antenna mount does not extend above the maximum height of the roof fairing. In the preferred embodiments of the invention, the antenna mount is at least six inches below the maximum height of the fairing. Additionally, in the preferred embodiments of the invention, the antenna mount is installed on a roof fairing such that the plane of orientation of the antenna mount defines an angle relative to the plane of the roof of the rear trailer towed by the tractor trailer truck, does not exceed 12 degrees. Preferably, the antenna mount is disposed off-center and closer to the driver's side of the cab than the passenger's side of the cab so as to avoid damage to the antenna by overhead obstructions on the right side of the road, as for example tree branches extending into the roadway.

In the preferred embodiments of the invention, cowls and covers can be provided to protect the antenna installed in the antenna mount. The covers and cowls can be integrally defined with the roof fairing, or can be provided as separately removable components. Preferably the cover or cowl is designed to be streamlined to reduce any aerodynamic drag which might be caused by the antenna or the antenna mount extending beyond the outer surface of the fairing.

The present invention enables an antenna for a motor vehicle, particularly a satellite antenna, to be installed externally on air deflection equipment, particularly roof fairings, for motor vehicles thereby enhancing signal transmission and reception and avoiding other known disadvantages associated with antennas partially or completely enclosed internally within air deflection equipment on the motor vehicle. However, the antenna mount is positioned and oriented relative to the roof fairing and the motor vehicle so as to significantly reduce and minimize known disadvantages associated with externally mounted antennas. In the preferred embodiments of the invention, the antenna is fixedly mounted in the antenna mount, thereby eliminating the use of moving parts or other complicated mechanical structures to reduce the overall cost of the antenna mount. Although the antenna mount in accordance with the present invention is particularly useful in connection with satellite antennas, it is also useful for other types of antennas employed for communications with motor vehicles, particularly tractor trailer trucks.

DESCRIPTION OF THE BEST MODES FOR CARRYING OUT THE INVENTION

Figure 1:
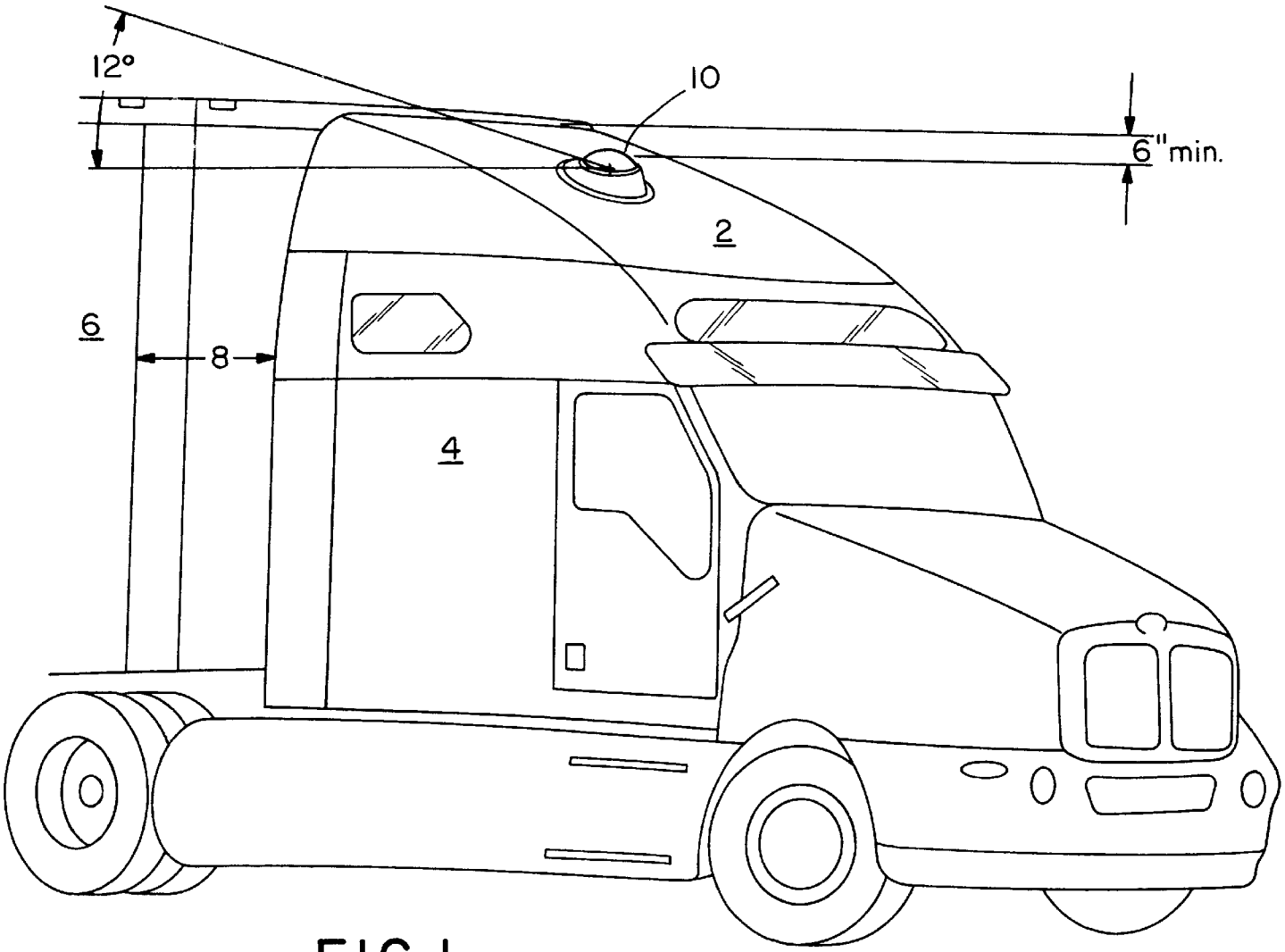
FIG. 1 is a perspective view of an antenna mounted to the outer surface of a roof fairing of a motor vehicle in accordance with the present invention.

FIG. 1 is a perspective view of a roof fairing, generally designated by reference numeral 2, mounted to the cab 4 of a tractor trailer truck. The cab is coupled to a rear trailer generally designated by reference numeral 6, and a gap space 8 is defined between the rear wall of the cab and the front wall of the trailer. An antenna mounted to the outer surface of the roof fairing 2 is generally designated by reference numeral 10. As illustrated in FIG. 1, the antenna 10 is mounted to the outer surface of the roof fairing 2 at an elevation which is approximately between zero and six inches or more below the maximum height of the roof fairing, and at an angle (hereinafter referred to as the "look" angle) of approximately 12 degrees relative to the roof of the rear trailer 6.

Roof fairings for motor vehicles, such as that generally designated by reference numeral 2 of the drawings, are well known to the art. Roof fairings are air deflection devices mounted to or defined on the top of the cab of a tractor trailer truck for diverting the flow of air over the roof of the trailer when the vehicle is in operation. In this manner, air does not impact against the top portion of the front wall of the trailer, thereby reducing drag on the vehicle as it is driven. Drag reduction advantageously reduces the fuel consumption of the vehicle.

Although the invention disclosed herein is discussed primarily with respect to roof fairings for motor vehicles, it is equally applicable to other types of air drag reduction or air deflection equipment including fairings mounted to the roofs of cabs of motor vehicles; fairings formed integrally as roofs (or portions of roofs) of cabs; fairings formed integrally as raised roofs (or portions of raised roofs) of cabs; air deflection or drag reduction plates mounted to the roof of cabs of motor vehicles; or any other type of equipment mounted to or integrally formed as part of a motor vehicle for the purpose of reducing air drag when the vehicle is operated. Moreover, as used herein, roof fairing is intended to mean both fairings mounted to the roofs of cabs of motor vehicles, and roofs of cabs of motor vehicles integrally formed, at least in part, in a fairing configuration.

Figure 2:
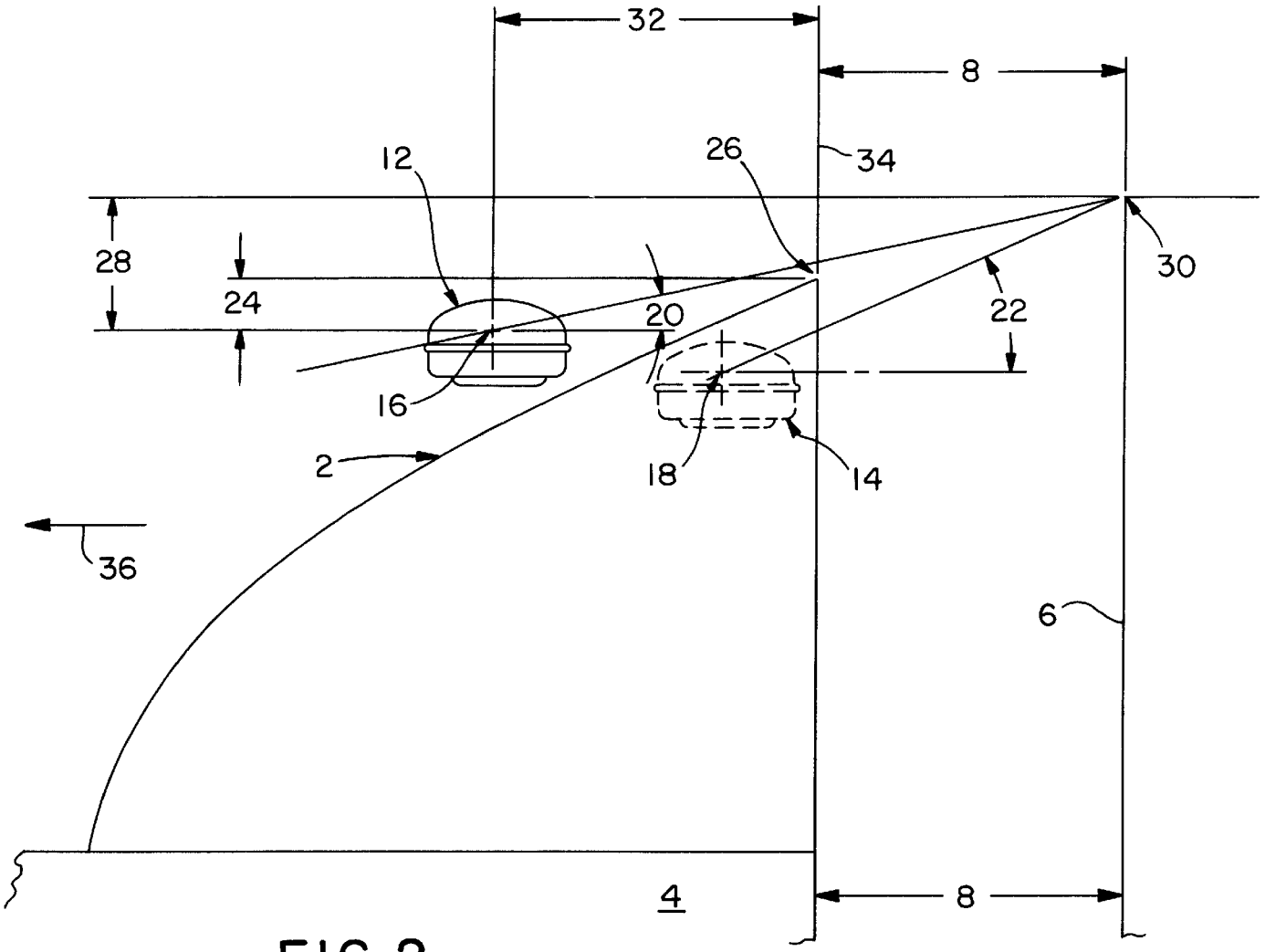
FIG. 2 schematically illustrates two different positions of an antenna mounted relative to a roof fairing mounted to a motor vehicle.

FIG. 2 schematically illustrates and compares the position of an antenna mounted to a roof fairing in accordance with the present invention, with the position of a conventional antenna mounted relative to a roof fairing. An antenna in accordance with one embodiment of the present invention is designated by reference numeral 12 and is shown mounted in a position beyond the outer surface of a roof fairing 2. Reference numeral 14 illustrates an antenna mounted in a conventional position beneath the outer surface 2 of a roof fairing. The electrical (or functional) center of antenna 12 is designated by reference numeral 16, and the electrical (or functional) center of antenna 14 is designated by reference numeral 18. Reference numeral 20 designates the sight angle or "look angle" of antenna 16, while reference numeral 22 designates that sight angle or "look angle" of antenna 18. Reference numeral 24 designates vertical distance between the functional center 16 of the antenna 12 and the highest point of the roof fairing designated by reference numeral 26. Reference numeral 28 designates the vertical distance between the functional center 16 of the antenna 12 and the roof 30 of the trailer 6. Reference numeral 32 designates the distance between the functional center 16 of the antenna 12 and the rear wall 34 of the cab 4, while reference numeral 8 designates the space between the rear wall of the cab and the front wall of the trailer as is also illustrated in FIG. 1. The forward direction of operation of the vehicle to which the fairing 2 is mounted is designated by arrow 36.

Still referring to FIG. 2, conventional antenna design advocates positioning the antenna behind or underneath the roof fairing 2, as illustrated by reference numeral 18. This practice strives to preserve the aesthetics and aerodynamics of the roof fairing 2 at the expense of antenna performance including communications reliability. On the contrary, the basic concept of the present invention is to position the antenna at or beyond the outer surface of a roof fairing, as generally illustrated by antenna 12, to result in maximum antenna performance including communications reliability. The antenna mount preferably is aerodynamically designed to surround the antenna and to minimize any increase in drag resulting from mounting the antenna to extend beyond the outer surface of the roof fairing. Generally, the designer of an antenna mount for a roof fairing for a motor vehicle is faced with several compromises. The antenna is preferably mounted as high as possible above the ground to achieve the lowest sight angle (compare reference numerals 20 and 22 of FIG. 2) for optimal antenna performance, but should also be mounted as low as possible in order to reduce the possibility of damage to the antenna as a result of overhead obstructions such as tree branches, power lines, and the like, as the vehicle is being operated. For optimal performance of the antenna, solid material such as the fairing itself, the antenna mount, portions of the vehicle, and portions of equipment mounted to the vehicle, should not be in the line of sight of the antenna.

The antenna mount of the present invention addresses the aforementioned conflicting considerations inherent in the design of an antenna mounted to a motor vehicle. Among other things, the antenna mount in accordance with the preferred embodiments of the present invention, as schematically illustrated by antenna 12 of FIG. 2, is oriented flush, or above, the outer surface of roof fairing 2, is elevated such that its electrical center 16 is no higher than (and preferably at about between zero to six inches below), the highest point 26 of the roof fairing 2, and that the line of sight angle 20 of the antenna 12 relative to the roof 30 of the trailer 6 is preferably in the range of between 0 degrees–12 degrees. The antennas useful in connection with the present invention include satellite, radio, television, radar and any other antennas which can be used in a motor vehicle. The antenna mount in accordance with present invention is useful in connection with numerous types of vehicles including the trailing portion of a combination vehicle, such as a full trailer, a semi-trailer, or the leading component in a multiple tandem trailer; vans; tankers; flatbeds; and bulk trailers. The roof fairings to which the antennas are mounted include any structures affixed to the cab of a vehicle for the purpose of reducing aerodynamic drag, and also includes any raised roof portions integrally defined on a cab for the purpose of reducing air drag during operation of the vehicle.

Figure 3:
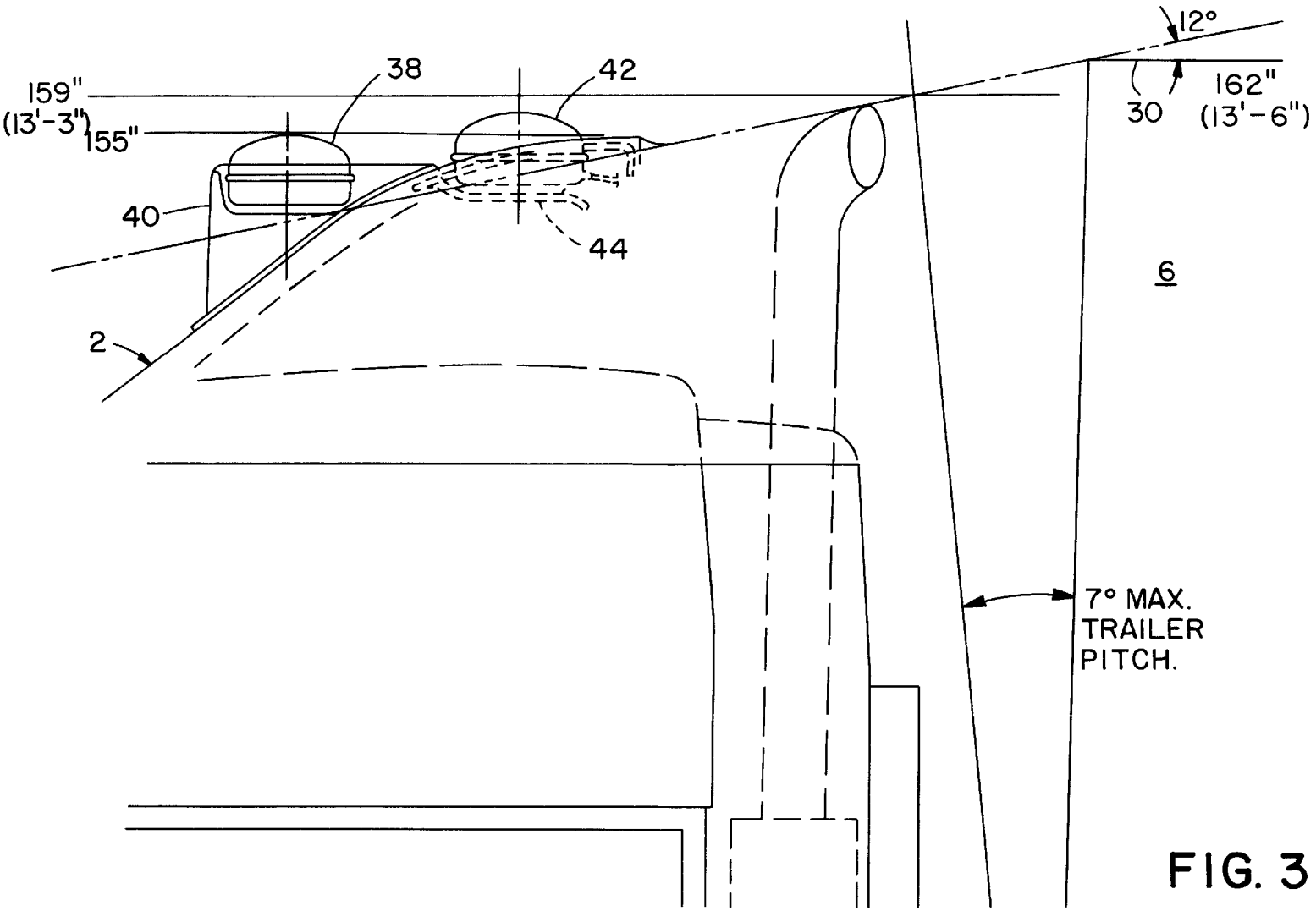
FIG. 3 is a side elevational view, partly in section, illustrating different positions of an antenna relative to a roof fairing mounted to a motor vehicle.

FIG. 3 is a side elevational view, showing different orientations of antennas mounted to roof fairings in accordance with the present invention. The antenna designated by reference numeral 38 is mounted to the outer surface of roof fairing 2 by a separate supporting element 40 mounted to the outer surface of the roof fairing 2. The antenna designated by reference numeral 42 is mounted in an opening cut through a portion of the outer surface of the roof fairing 2, such that the top portion of the antenna 42 extends beyond the outer surface of the roof fairing 2, and the lower portion of the antenna 42 is below the outer surface of the roof fairing 2. A separate mounting element 44, attached at one end to the roof fairing surface 2, extends beneath the roof fairing for supporting the bottom of the antenna 42. Both of the antennas 38 and 42 are mounted relative to the roof fairing 2 in accordance with the preferred embodiments of the present invention—namely, the functional center of each antenna is beneath the highest elevated point of the roof fairing (and preferably at about between zero to six inches therebelow), the line of sight angle between the antenna and the plane of the roof 30 of the rear trailer 6 is in the range of between 0 degrees–12 degrees, and the functional center of each antenna is at least flush with or above the outer surface of the roof fairing 2.

Figure 4:
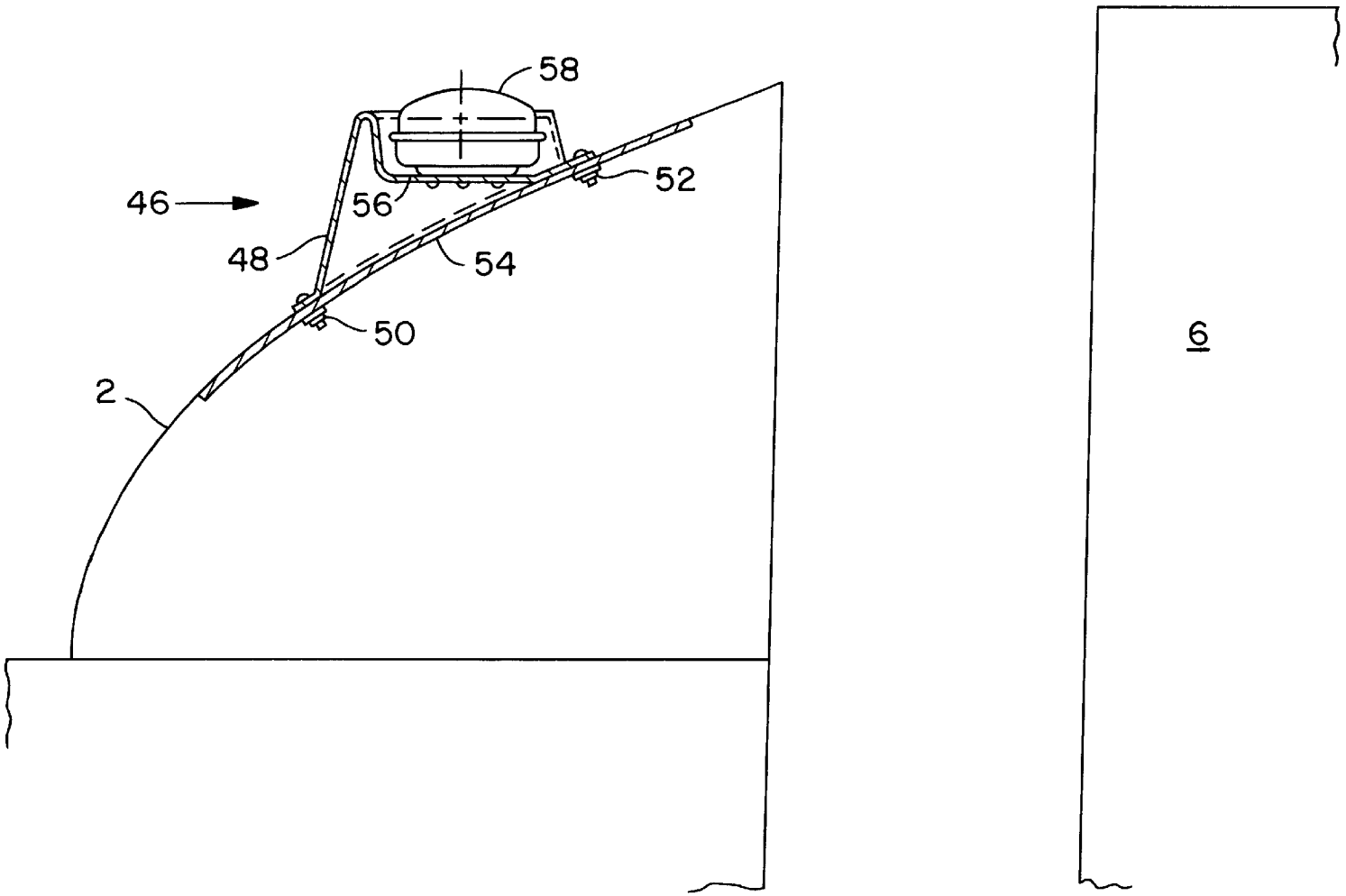
FIG. 4 schematically illustrates a first embodiment of an antenna mounted above the outer surface of a roof fairing of a motor vehicle.

FIG. 4 schematically illustrates the manner in which an antenna in accordance with the present invention can be mounted to a pre-existing roof fairing beyond the outer surface thereof. A mounting element, generally designated by reference numeral 46, includes an extended portion 48 which is bolted at 50 to the outer surface of a roof fairing 2. The opposed end of the supporting element is also bolted at 52 to a higher elevated portion of the roof fairing 2. A mounting plate 54 is optionally provided on the inner surface of the roof fairing 2 for receiving the bolts. A recessed portion 56 of the supporting element 46 is defined for receiving therein an antenna 58.

Figure 5:
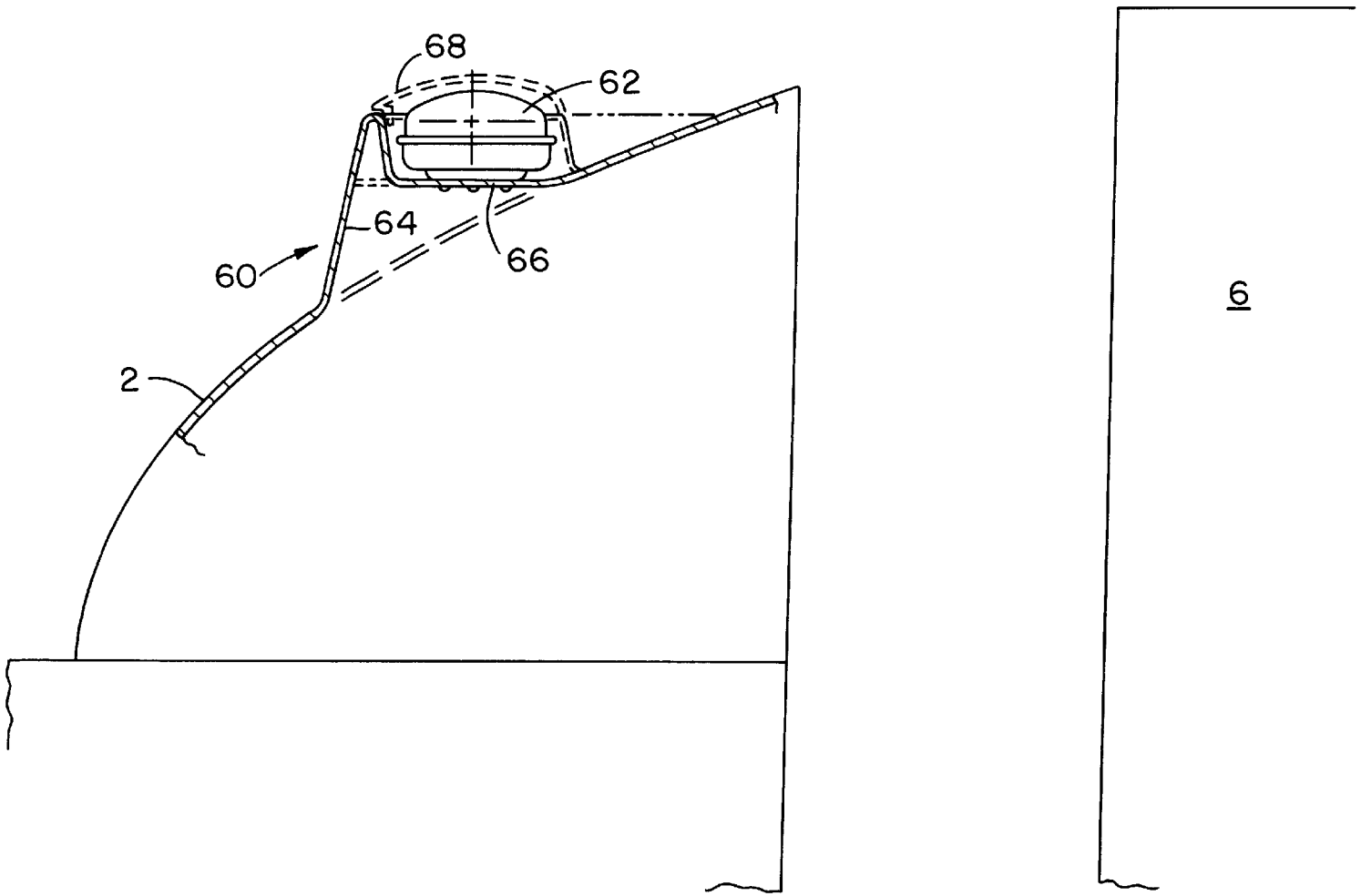
FIG. 5 illustrates a second embodiment of an antenna mounted above the outer surface of a roof fairing of a motor vehicle.

FIG. 5 schematically illustrates a supporting element, generally designated by reference numeral 60, for supporting an antenna 62 beyond the outer surface of a roof fairing 2. The supporting element is integrally formed from a portion of the roof fairing defined by an upwardly extending vertical segment 64, and a recessed horizontally extending segment 66 for supporting the bottom of the antenna 62. In this orientation, the antenna 62 is mounted outside of or beyond the outer surface of the roof fairing 2. The supporting element 60 can be formed by molding during fabrication of the roof fairing 2. A removable cover or cowl, generally designated by reference numeral 68, can be mounted above the top surface of the antenna 62 to increase the aerodynamic efficiency of the supporting element 60 (In a similar manner, a cowl or cover can be removably mounted above the top surface of the antenna 58 illustrated by FIG. 4 for increasing the aerodynamic efficiency of, and providing additional physical protection from overhead hazards to, the antenna in the embodiment illustrated by that earlier drawing).

Figure 6:
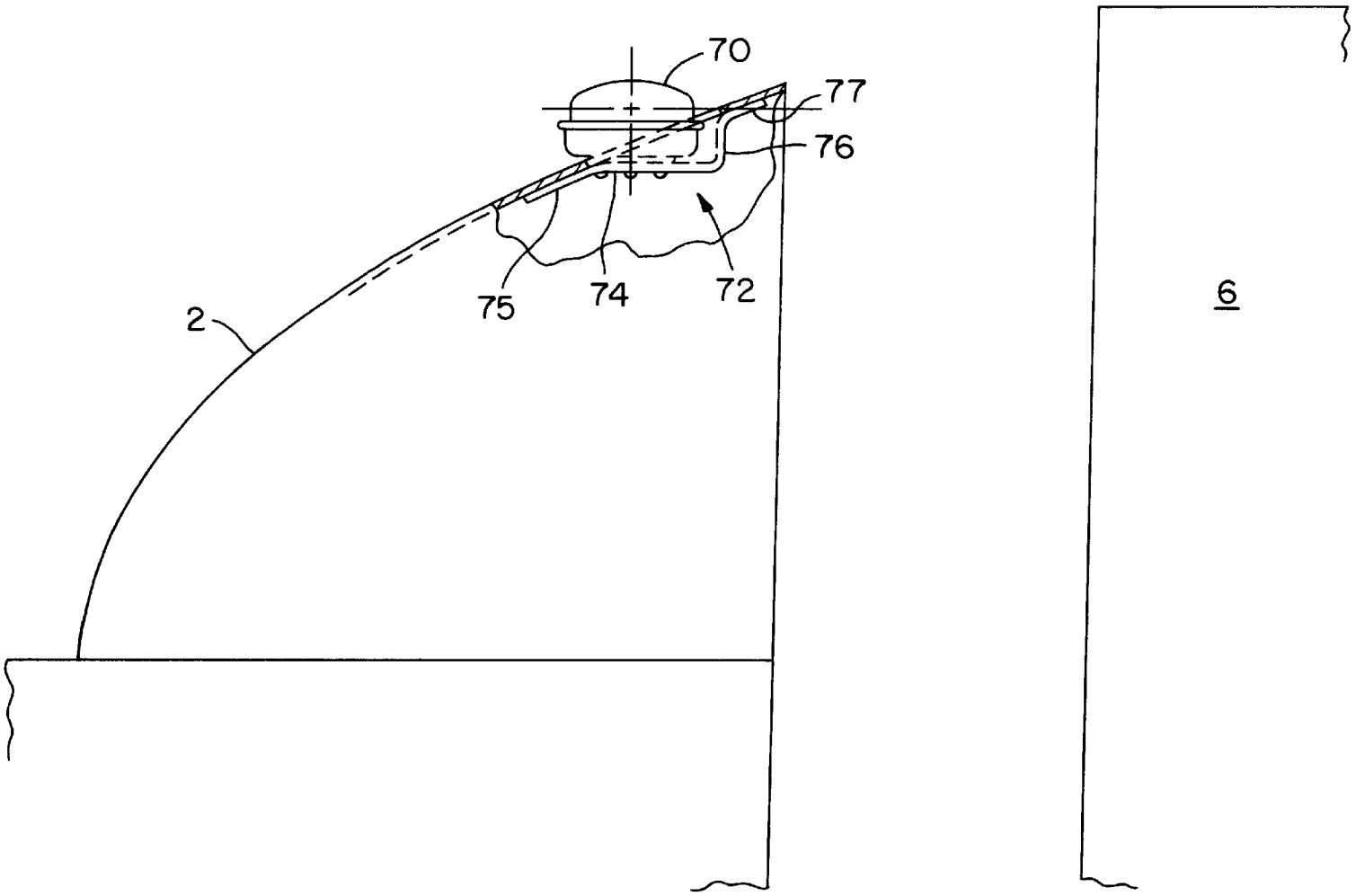
FIG. 6 illustrates a third embodiment of an antenna mounted through the outer surface of a roof fairing of a motor vehicle.

FIG. 6 illustrates an antenna 70 mounted in an opening defined in a portion of the outer surface of a roof fairing 2. An internally extending supporting element 72, including a first horizontal segment 74 attached to one portion of the roof fairing 2, and a generally upwardly extending vertical portion 76 attached to a second upper portion of the roof fairing 2, supports the portion of the bottom of the antenna 70 extending into the opening in the roof fairing 2. The supporting element 72 can be added to a pre-existing roof fairing 2 by cutting an opening in the outer surface of the roof fairing, and mounting the supporting element to the inner surface of the roof fairing 2 by mounting segments 75 and 77 extending from the supporting element 72, as illustrated by FIG. 6. A removable cover or cowl, as illustrated by FIG. 5, can also be mounted over the top of the antenna 70 in the embodiment illustrated by FIG. 6.

Figure 7:
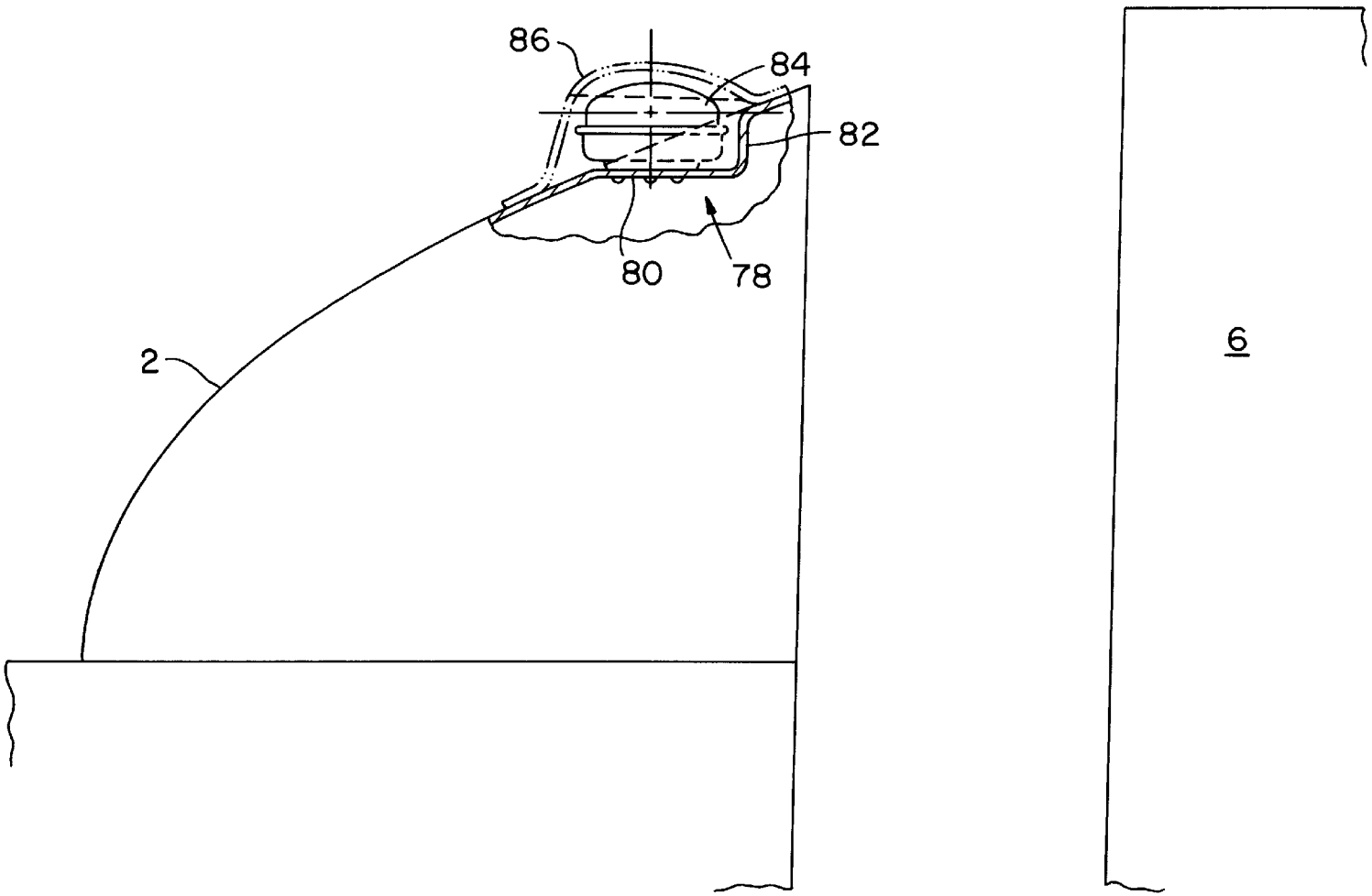
FIG. 7 illustrates a fourth embodiment of an antenna mounted through the outer surface of a roof fairing of a motor vehicle.

FIG. 7 illustrates a supporting element 78 defined integrally with a portion of the outer surface of a roof fairing 2. The supporting element 78 is formed from a first generally horizontally oriented segment 80, and a second upwardly extending generally vertically oriented segment 82. The bottom of an antenna 84 is supported on the inwardly extending horizontal segment 80 of the support element 78 such that the forward and upper portions of the antenna 84 are above and extend beyond the contour of the outer surface of the roof fairing 2. A cowl or cover, designated by reference numeral 86, is oriented above the top of the antenna 84. The cowl can be provided as a separate element removably mounted to the outer surface of the roof fairing 2.

Figure 8:
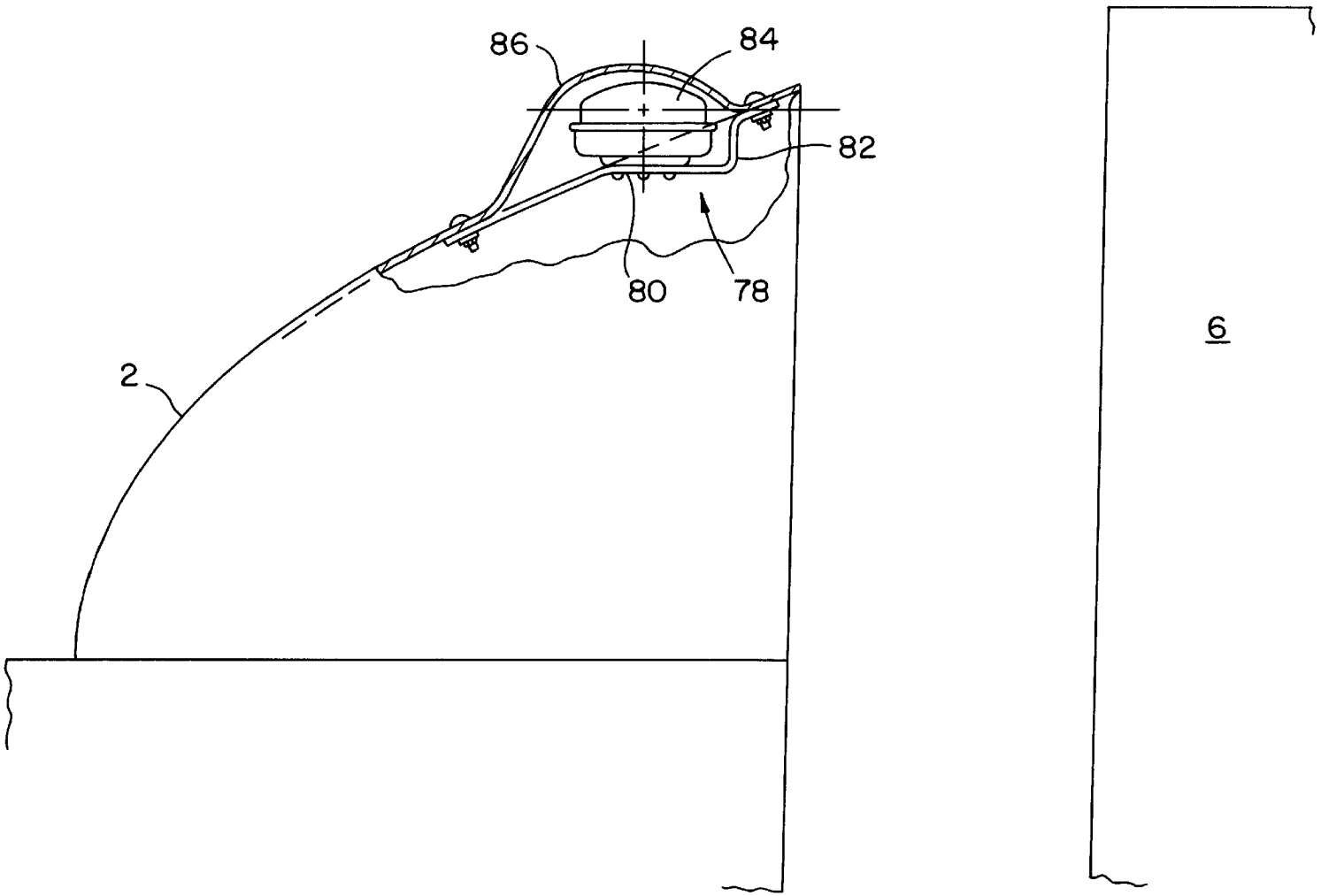
FIG. 8 illustrates a fifth embodiment of an antenna mounted partially through the outer surface of a roof fairing having a cover or cowl integrally formed with the fairing for providing a protective space for the antenna.

FIG. 8 illustrates an embodiment of the invention similar to that illustrated by FIG. 7, except that the cowl 86 is integrally formed from a portion of the outer surface of the roof fairing 2. The same reference numbers are used in FIGS. 7 and 8 to illustrate the same elements. The supporting element 78 in both FIGS. 7 and 8 is formed by molding during the fabrication of the roof fairing 2.

The embodiments of the present invention discussed herein provide means for mounting antennas to roof fairings for motor vehicles by which the mounting means can be provided during fabrication of the roof fairing, or the mounting means can be added to pre-existing roof fairings. The antenna is oriented relative to the roof fairing such that it can extend in its entirety beyond the outer surface of the roof fairing, or the antenna can be mounted relative to the roof fairing such that only a portion of the antenna extends beyond the outer surface of the roof fairing. Additionally, in all embodiments discussed herein, covers or cowls, can be provided over the portions of antennas extending beyond the contour of the outer surface of the roof fairing for the purposes of both protecting the antennas and minimizing any aerodynamic drag resulting from the portion of the antennas extending beyond the outer surface of the roof fairing.

The roof fairings on which the antennas are mounted are formed from a moldable material, as for example, a durable plastic or fiberglass. Likewise, the supporting elements for the antennas preferably are formed from moldable material such as durable plastic or fiberglass. When the supporting element is integrally formed with the roof fairing in accordance certain embodiments of the present invention, the roof fairing and the supporting element will necessarily be formed from the same material and the integral structure will be fabricated in a single molding process. Fiberglass is the preferred material of manufacture because it is both durable and lightweight, thereby reducing the load carried by the vehicle to which the fairing and supporting element are mounted. When the supporting element is added to a pre-existing roof fairing in accordance with some of the embodiments of the invention discussed herein, the supporting element is likewise preferably formed from a lightweight, durable material which can be different from the material from which the roof fairing is formed. For example, a lightweight durable metal, as for example, aluminum can be used to fabricate the supporting element.

Other modifications of the preferred embodiments discussed herein, within the scope of the present invention, will become apparent to those skilled in the art. For example, although the invention has been discussed herein primarily with respect to roof fairings, this has been done for illustrative purposes and is not intended to limit the scope of the invention. As discussed previously herein, the invention is adapted to be used with all types of drag reduction equipment for motor vehicles including fairings mounted to the cabs of vehicles, fairings formed integrally as a cab roof, fairings formed integrally as a raised cab roof, and other types of drag reduction equipment mounted to or formed as part of a motor vehicle. Also, although the invention has been discussed as being useful with satellite antennas, it may also be used with other types of antennas for motor vehicles.

Accordingly, the discussion of the preferred embodiments herein is intended to be illustrative but not restrictive of the scope of the invention, that scope being defined by the following claims in all equivalents thereto.

What is claimed is:

1. A supporting element for an antenna for a motor vehicle, said supporting element being mounted to drag reduction equipment of said motor vehicle such that at least a portion of an antenna carried by said supporting element extends beyond the outer surface of said drag reduction equipment, said supporting element being oriented relative to said drag reduction equipment such that the top of said antenna does not extend beyond the highest elevated position of said drag reduction equipment.

2. The supporting element as claimed in claim 1 wherein said supporting element is oriented relative to said drag reduction equipment such that the top of said antenna carried by said supporting element is lower than the highest elevated position of said drag reduction equipment.

3. The supporting element as claimed in claim 1 wherein said supporting element is oriented relative to said drag reduction equipment such that the top of said antenna is between 0–6 inches below said highest elevated position of said drag reduction equipment.

4. The supporting element as claimed in claim 1 wherein said supporting element is oriented relative to said drag reduction equipment such that the angle of orientation of said antenna carried by said supporting element relative to a horizontal plane is greater than 0 degrees.

5. The supporting element as claimed in claim 4 wherein said angle of orientation is in a range of between 0 degrees–12 degrees.

6. The supporting element as claimed in claim 1 wherein said supporting element is oriented relative to said drag reduction equipment such that the antenna carried by said supporting element extends beyond the outer surface of said drag reduction equipment in its entirety.

7. The supporting element as claimed in claim 1 further including means for mounting said supporting element to the outer surface of said drag reduction equipment.

8. The supporting element as claimed in claim 1 including means for mounting said supporting element to said drag reduction equipment through an opening defined in said outer surface of said drag reduction equipment such that only a portion of said antenna carried by said supporting element extends beyond an outer surface of said drag reduction equipment.

9. The supporting element as claimed in claim 1 further including means for mounting said supporting element to said drag reduction equipment such that said supporting element is spaced a predetermined distance beyond an outer surface of said drag reduction equipment.

10. The supporting element as claimed in claim 1 wherein said supporting element is formed integrally with said drag reduction equipment.

11. The supporting element as claimed in claim 10 wherein said supporting element defines a recessed space extending inwardly into said drag reduction equipment.

12. The supporting element as claimed in claim 1 further including a cover removably mountable over said supporting element and said antenna carried by said supporting element.

13. A supporting element for an antenna mounted to a roof fairing on the cab of a motor vehicle, said cab adapted to tow a rear trailer, said supporting element oriented relative to said roof fairing and said rear trailer of said motor vehicle such that the top of an antenna carried by said supporting element does not extend above either the highest elevation of said roof fairing and the highest elevation of a roof of said trailer, said supporting element being oriented such that the angle of said antenna carried by said supporting element relative to said roof of said rear trailer is greater than 0 degrees.

14. The supporting element as claimed in claim 13 wherein said supporting element is mounted, at least in part, to an outer surface of said roof fairing.

15. The supporting element as claimed in claim 13 wherein said supporting element is integrally formed with said roof fairing.

16. A communication system for a motor vehicle, said communication system comprising an antenna and a supporting element for said antenna, said supporting element for said antenna being operatively associated with drag reduction equipment of said motor vehicle, said supporting element being oriented relative to said drag reduction equipment such that at least a portion of said antenna carried by said supporting element extends beyond an outer surface of said drag reduction equipment and the top of said antenna does not extend above the highest elevated portion of said drag reduction equipment, said supporting element being oriented relative to said drag reduction equipment such that the angle of said antenna relative to a horizontal plane over which said motor vehicle is driven is greater than 0 degrees.

17. The system as claimed in claim 16 further including a cover removably mountable to said supporting element and over said antenna carried by said supporting element.

18. The system as claimed in claim 16 further including a cover disposed over said antenna carried by said supporting element, said cover being integrally formed with said drag reduction equipment.

19. The system as claimed in claim 16 wherein said supporting element is mounted, at least in part, to the outer surface of said drag reduction equipment.

20. The system as claimed in claim 16 wherein said supporting element is integrally formed with said drag reduction equipment.

21. A communication system for a motor vehicle, said communication system comprising drag reduction equipment operatively associated with said motor vehicle, and an antenna and a supporting element for said antenna; said supporting element for said antenna being mounted to said drag reduction equipment, and said antenna being fixedly mounted to said supporting element; said supporting element being oriented relative to said drag reduction equipment such that at least a portion of said antenna carried by said supporting equipment extends beyond an outer surface of said drag reduction equipment and the top of said antenna does not extend above the highest elevated portion of said drag reduction equipment; said supporting element being oriented relative to said drag reduction equipment such that the angle of said antenna relative to a horizontal plane over which said motor vehicle is driven is greater than 0 degrees.

* * * * *

UNITED STATES PATENT AND TRADEMARK OFFICE

CERTIFICATE OF CORRECTION

PATENT NO. : 6,204,820 B1
DATED : March 20, 2001
INVENTOR(S) : William L. Jensen, Jr.

It is certified that error appears in the above-identified patent and that said Letters Patent is hereby corrected as shown below:

Title page,
Item [56], under References Cited, add:

| | | |
|---|---|---|
| 5,755,485* | 5/98 | Christie et al……..296/180.1 |
| 5,410,325* | 4/95 | Friedrich et al……343/713 |
| 5,402,134* | 3/95 | Miller et al…….343/742 |
| 5,389,942* | 2/95 | Oglesby, Jr…….343/872 |
| 5,337,062* | 8/94 | Sherwood et al……343/711 |
| 5,174,626* | 12/92 | Wiley, Jr et al…....296/180.1 |
| 4,931,809* | 6/90 | Putnam et al……343/882 |
| 4,784,424* | 11/88 | Wiley, Jr……296/180.2 |
| 4,919,472* | 4/90 | Wiley, Jr……296/180.2 |
| 4,370,658* | 1/83 | Hill……..343/713 |
| D339,314* | 9/93 | Moar……D12/96 |
| D314,163* | 1/91 | Harris et al……...D12/96 |
| D249,783* | 10/78 | Herpel……..D12/181 |

* cited by Applicant

Signed and Sealed this

Thirteenth Day of August, 2002

*Attest:*

*Attesting Officer*

JAMES E. ROGAN
*Director of the United States Patent and Trademark Office*